US008658918B1

(12) United States Patent
Li et al.

(10) Patent No.: US 8,658,918 B1
(45) Date of Patent: Feb. 25, 2014

(54) POWER GENERATION USING A HEAT TRANSFER DEVICE AND CLOSED LOOP WORKING FLUID

(75) Inventors: Heng-Yi Li, New Taipei (TW); Chun-Wei Yang, Taoyuan County (TW); Shih-Tse Chang, New Taipei (TW); Tsair-Fuh Huang, Taoyuan County (TW); How-Ming Lee, Taoyuan County (TW); Chin-Ching Tzeng, New Taipei (TW)

(73) Assignee: Institute of Nuclear Energy Research, Atomic Energy Council, Lungtan, Taoyuan (TW)

( * ) Notice: Subject to any disclaimer, the term of this patent is extended or adjusted under 35 U.S.C. 154(b) by 61 days.

(21) Appl. No.: 13/607,029

(22) Filed: Sep. 7, 2012

(51) Int. Cl.
*H01H 9/54* (2006.01)

(52) U.S. Cl.
USPC ..... 200/2; 60/641.1

(58) Field of Classification Search
USPC ..... 200/2; 60/641.1, 641.2, 641.8
IPC ..... Y02E 20/14
See application file for complete search history.

(56) References Cited

U.S. PATENT DOCUMENTS

| | | | | |
|---|---|---|---|---|
| 4,290,266 | A * | 9/1981 | Twite et al. | 60/641.2 |
| 7,492,052 | B2 * | 2/2009 | Stumm | 290/2 |
| 8,176,724 | B2 * | 5/2012 | Smith | 60/39.53 |
| 2010/0199667 | A1 * | 8/2010 | Ullman | 60/641.2 |

* cited by examiner

*Primary Examiner* — Vanessa Girardi
(74) *Attorney, Agent, or Firm* — Jackson IPG PLLC

(57) ABSTRACT

A fast heat transfer device is provided. The device dissipates heat and generates power at the same time. A liquid flow is used to absorb heat for forming a vapor gas flow; then, the gas flow drives a blade turbine and a power generator; and, finally, the gas flow is cooled down to become the original liquid flow for recycling. Thus, the present invention dissipates heat and generates power simultaneously with a minimized size and a reduced cost together with energy conservation.

11 Claims, 4 Drawing Sheets

POWER GENERATION USING A HEAT TRANSFER DEVICE AND CLOSED LOOP WORKING FLUID

TECHNICAL FIELD OF THE INVENTION

The present invention relates to a fast heat transfer device; more particularly, relates to simultaneously dissipating heat and generating power without using a capillary structure and a pressure pump.

DESCRIPTION OF THE RELATED ARTS

In our daily life, many utilities need to dissipate heat for functioning normally, like a central processing unit (CPU) of a personal computer or a condenser of an air conditioner. Besides, some industrial waste heat is produced and dissipated into the environment without recycling, like the heat generated by smelting furnace and industrial kiln. Heat pipe has far better thermal conductivity than metals, like aluminum, copper, silver, gold, etc., and, so, is integrated with heat transfer devices. Besides, the heat pipe can be used to fabricate a heat convection device for recycling the industrial waste heat.

Basically, a heat pipe is a closed chamber containing working fluid. By phase changes between gas flow and liquid flow in the chamber, and the convection between the gas flow and the liquid flow at heat absorption end and heat dissipation end, heat is dissipated by the fast thermal equilibrium of the chamber. At first, the liquid flow evaporates into the gas flow at the heat absorption end. At the moment, a local high pressure is formed in the chamber and drives the gas flow toward the heat dissipation end at a rapid speed. After the gas flow condenses into the liquid flow at the heat dissipation end, the condensing liquid flow returns the heat absorption end by gravity, capillary and centrifugal force. A recycling process is thus formed. On using the heat pipe, the gas flow is driven by gas pressure difference; and the liquid flow is depending on the operation state. The heat pipe has different forms, including capillary porous pipe, loop heat pipe and thermosyphon heat pipe. Although the capillary porous pipe and the loop heat pipe have very high theoretical heat fluxes, they require capillary structures which increase fabrication difficulties and costs. In FIG. 3, a traditional thermosyphon heat pipe comprises an evaporator 101, a gas channel 102, a condenser 103 and a liquid channel 104. A liquid flow in the evaporator 101 absorbs heat of a heat source to evaporate and convert to a gas flow. Then, the gas flow ascends owing to a density difference between liquid and gas to flow into the condenser 103 through the gas channel 102. The gas flow condenses into the liquid flow in the condenser 103 by heat rejection. At last, the liquid flow returns the evaporator 104 by gravity through the liquid channel 104. A flow cycle is thus formed. The heat source can be solar heat, high-power electric device, the waste heat of internal combustion engine, industrial waste heat, geothermal heat, ocean temperature difference or nuclear reactor. The thermosyphon heat pipe forms a general cycle mainly by the density difference between gas and liquid, and the gravity. It does not need capillary structure and pressure pump. The heat from the heat source is transferred from the evaporator 101 to the condenser 103 to be dissipated. However, thermosyphon heat pipe dissipates heat only and can not generate power.

Furthermore, a traditional Rankine cycle system is usually used in coal power plant or an organic Rankine cycle power plant, as shown in FIG. 4. The Rankine cycle system comprises a boiler 201, a high-pressure gas channel 202, an expanding turbine 203, a low-pressure gas channel 204, a condenser 205, a low-pressure liquid channel 206, a pressure pump 207 and a high-pressure liquid channel 208. A liquid flow in the boiler 201 is heated by a heat source to become a high-pressure gas flow. Through the high-pressure gas channel 202, the high-pressure gas flow pushes the expanding turbine 203 to work. After working through expansion, the gas flow becomes low pressure and enters into the condenser 205 through the low-pressure gas channel 204 to condense into the liquid flow. At last, after being pressured by the pressure pump 207 through the low-pressure liquid channel 206, the liquid flow returns the boiler 201 through the high-pressure liquid channel 208. The Rankine cycle system works mainly by the working fluid inside absorbing heat and expanding, and requires the pressure pump 207 to pressure the working fluid to return the boiler 201 or an evaporator. As a result, the size of the system is big and cost is high.

In short, the thermosyphon heat pipe dissipates heat only and can not generates power; and the Rankine cycle system requires a pressure pump to pressure working fluid to a boiler or an evaporator. Hence, the prior arts do not fulfill all users' requests on actual use.

SUMMARY OF THE INVENTION

The main purpose of the present invention is to simultaneously dissipate heat and generate power without using a capillary structure and a pressure pump.

The other purpose of the present invention is to provide a minimized device for dissipating heat and generating power with reduced cost and energy conservation.

To achieve the above purposes, the present invention is a fast heat transfer device for simultaneously dissipating heat and generating power, comprising an evaporator, a high-pressure vapor pipe, a condenser, a direct-current (DC) generator, a cooling fin, a liquid collecting tank, a return flow pipe and a supporting frame, a evaporator which is a high-pressure container having two spaces; the first space is upper and filled with gas working fluid and the second space is lower and filled with liquid working fluid, respectively; a filling port and a valve is mounted at the top of the evaporator; the working fluid fills the evaporator through the filling port and the valve; the bottom of the evaporator is connected with a heat source to transfer heat of the heat source through wall of the evaporator; the liquid working fluid evaporates to the gas working fluid by absorbing the heat of the heat source through the wall of the evaporator; and the gas working fluid leaves the evaporator through the evaporator outlet at the top to high-pressure vapor pipe; the high-pressure vapor pipe outlet at the top is connected with the nozzle inside the bottom of the condenser; the high-pressure vapor pipe inlet at the bottom is connected with the first space of the evaporator at the upside; and the high-pressure gas working fluid in the evaporator is hence guided by the high-pressure vapor pipe to the condenser; where a first bearing and a second bearing are mounted at the top and the bottom inside, respectively; a blade turbine and a axis are fixed between the first bearing and the second bearing; the condenser obtains the high-pressure gas working fluid through the high-pressure vapor pipe from the nozzle for driving the blade turbine to turn; the DC generator is set outside of the condenser at the top; and the DC generator generates power by the turning blade turbine transferring kinetic energy through the axis; and the high-pressure gas working fluid converts to the low-pressure gas working fluid flowing out from the blade turbine; the cooling fin is a cooling device outside of the condenser; and the low-pressure gas working fluid flowing out form the blade turbine contacts with inner wall of the condenser to reject heat by the cooling fin and condense to the liquid phase; the liquid collecting tank is set outside of the condenser at the bottom to collect the liquid working fluid formed by cooling the gas working fluid; a check valve is mounted at the bottom of the liquid collecting tank; and the check valve prevents the liquid working fluid in the evaporator flowing back to liquid collecting tank through the return flow pipe; the return flow pipe has an inlet at the top to be connected with the liquid collecting tank; the return flow pipe has an outlet at the bottom to be connected with the second space of the evaporator at the downside; and the return flow pipe guides the liquid working fluid in the liquid collecting tank to flow back to the evaporator; and the supporting frame fixes and supports the whole heat transfer device to be set on the heat source. Accordingly, a novel fast heat transfer device for simultaneously dissipating heat and generating power is obtained.

BRIEF DESCRIPTIONS OF THE DRAWINGS

The present invention will be better understood from the following detailed description of the preferred embodiment according to the present invention, taken in conjunction with the accompanying drawings, in which FIG. 1 is the view showing the preferred embodiment according to the present invention;

DESCRIPTION OF THE PREFERRED EMBODIMENT

The following description of the preferred embodiment is provided to understand the features and the structures of the present invention.

Figure 1:
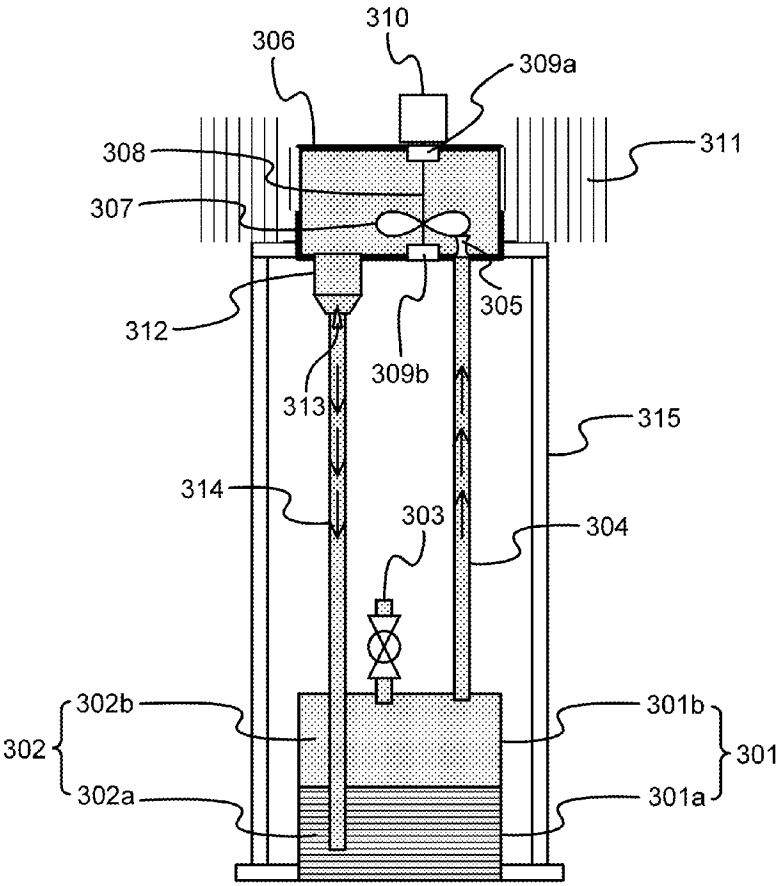
Figure 2:
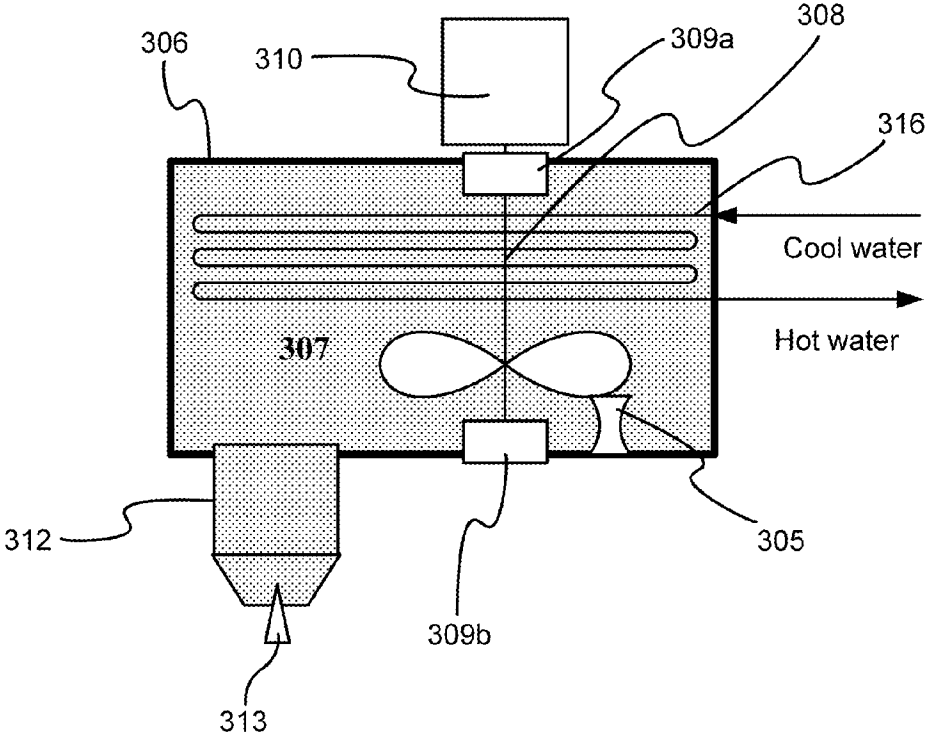
FIG. 2 is the view showing the condenser.
Figure 3:
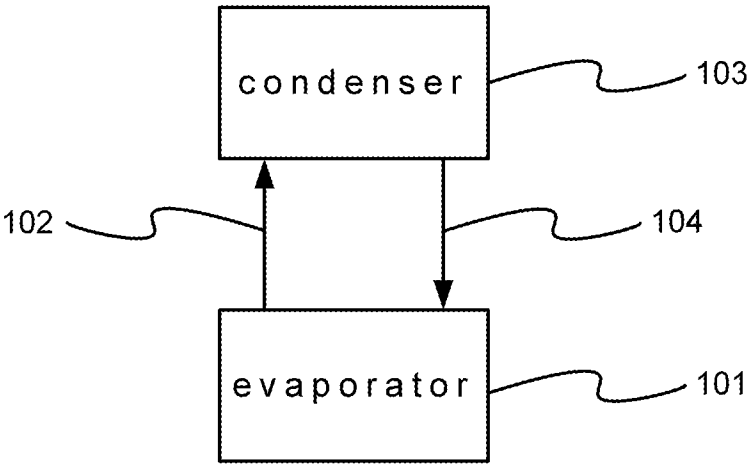
FIG.3 (prior art)
FIG. 3 is the view of the first prior art.
Figure 4:
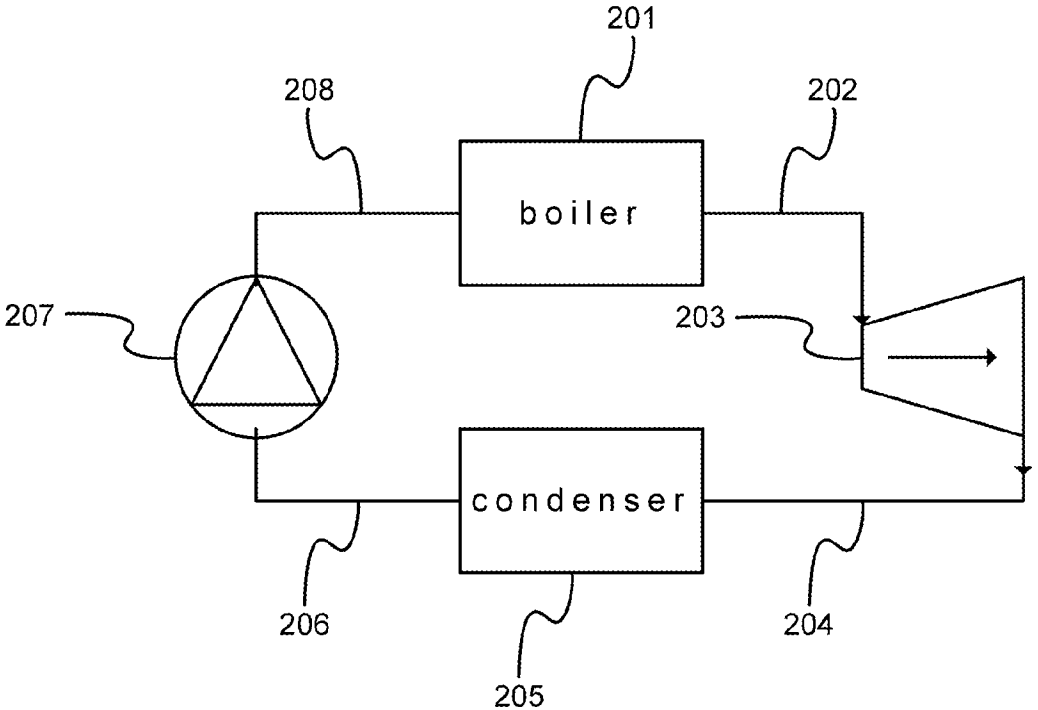
FIG.4 (prior art)
FIG. 4 is the view of the second prior art.

Please refer to FIG. 1 and FIG. 2, which are views showing the preferred embodiment and a condenser according to the present invention. As shown in the figures, the present invention is a fast heat transfer device for simultaneously dissipating heat and generating power, comprising an evaporator 301, a liquid working fluid 302*a*, a gas working fluid 302*b*, a filling port and a valve 303, a high-pressure vapor pipe 304, a nozzle 305, a condenser 306, a blade turbine 307, a axis 308, a first bearing 309*a*, a second bearing 309*b*, a direct-current (DC) generator 310, a cooling fin 311 (or a cooling coil 316), a liquid collecting tank 312, a check valve 313, a return flow pipe 314 and a supporting frame 315.

The evaporator 301 is a high-pressure container having working fluid 302; a first space 301*b* of the evaporator 301 at the upside is filled with a gas working fluid 302*b*; a second space 301*a* of the evaporator 301 at the downside is filled with a liquid working fluid 302*a*; the evaporator 301 is a high-pressure container capable of bearing heat expansions of the liquid working fluid 302*a* and the gas working fluid 302*b*; a filling port and a valve 303 is set at a first end of the evaporator 301 at the top for refilling the evaporator 301 with the working fluid 302; a second end of the evaporator 301 at the bottom is connected with a heat source to transfer heat of the heat source through wall of the evaporator 301; the liquid working fluid 302*a* in the second space 301*a* of the evaporator 301 evaporates into the gas working fluid 302*b* by the heat of the heat source absorbed through the wall of the evaporator 301; and, the gas working fluid 302*b* leaves from an outlet of the evaporator 301 at the top through the high-pressure vapor pipe 304;

An outlet of the high-pressure vapor pipe 304 at the top is connected with the nozzle 305 inside the condenser 306 at the downside; an input of the high-pressure vapor pipe 304 at the bottom is connected with the first space 301*b* of the evaporator 301 at the upside; and, the high-pressure gas working fluid in the evaporator 301 is guided to the condenser 306 by the high-pressure vapor pipe 304.

A first bearing 309*a* and a second bearing 309*b* are set at the upside and the downside inside the condenser 306, respectively; a blade turbine 307 and a axis 308 are fixed between the first bearing 309*a* and the second bearing 309*b*; the condenser 306 receives the high-pressure gas working fluid 302*b* from the high-pressure vapor pipe 304 through the nozzle 305 to make the blade turbine 307 turn; and, the heat is transferred to the cooling fin 311 and rejected to environment by air convection to form the liquid working fluid 302*a* after cooling the gas working fluid 302*b* by contacting with the wall. Therein, the nozzle 305 is located at the output of the high-pressure vapor pipe 304, which is corresponding to an input at the blade turbine 307; the axis 308 connects the blade turbine 307 and the DC generator 310 for transferring kinetic energy of the blade turbine to the DC generator 310; and, the first bearing 309*a* and the second bearing 309*b* are used to be low-rubbing contact surfaces between the axis 308 and the condenser 306, respectively.

The DC generator 310 is set outside of the condenser 306 at the top to receive kinetic energy transferred through the axis 308 from the blade turbine 307 for generating power.

The cooling fin 311 is set outside of the condenser 306; the low-pressure gas working fluid 302*b* flows out from the blade turbine 307 to contact with inner wall of the condenser 306 to dissipate heat and is formed into the liquid working fluid 302*a*. The cooling fin 311 is a heat-rejecting device and can be a cooling coil 316 surrounding on inner wall of the condenser 306, as shown in FIG. 2. And, cooling water flows into the cooling coil 316. When the cooling coil 316 is contacted with the low-pressure gas working fluid 302*b* flowing out from the blade turbine 307, the cooling water absorbs heat of the gas working fluid 302*b* so that not only the gas working fluid 302*b* condenses into the liquid working fluid 302*a* to be collected in the liquid collecting tank 312 but also the cooling water is heated to hot water and flows out from the cooling coil 316 for energy recycle.

The liquid collecting tank 312 is set outside of the condenser 306 at the downside, which is located at the lowest position of the condenser 306, to collect the liquid working fluid 302*a* formed by cooling the gas working fluid 302*b*; the check valve 313 is set between the downside of the liquid collecting tank 312 and an inlet of the return flow pipe 314 at the top to prevent the high-pressure liquid working fluid 302*a* in the second space 301*a* of the evaporator 301 from flowing back to the liquid collecting tank 312 and the condenser 306 through the return flow pipe 314. The check valve 313 has a spring device inside. When the weight of the liquid working fluid 302*a* in the liquid collecting tank 312 overwhelms the elastic force of the spring device, the check valve 313 is opened to allow the liquid working fluid 302*a* to flow back to the evaporator 301 through the return flow pipe 314.

The return flow pipe 314 has an inlet at the top to be connected with the liquid collecting tank 312; and has an outlet at the bottom to be connected with the second space 301*a* of the evaporator 301; and, the return flow pipe 314 guides the liquid working fluid 302*a* in the liquid collecting tank 312 to flow back to the evaporator 301.

The supporting frame 315 fixes and supports the whole heat transfer device to be set on the heat source.

Therein, the working fluid is made of water, carbon dioxide, ammonia, a refrigerant, a benzene or an alkane to be filled in containers and pipes in liquid or gas phases for flowing and recycling inside the whole system by density and gravity differences between gas and liquid phases while, at the same time, processing heat absorption, expansion and heat transferring; and, the filling port and the valve 303 is usually closed and is only opened for refilling the evaporator 301 with the working fluid 302, vacuuming air or measuring temperature and pressure.

Thus, a novel fast heat transfer device for simultaneously dissipating heat and generating power is obtained, which can dissipate heat and generate power without using a capillary structure and a pressure pump.

On using the present invention, the evaporator 301 is filled with working fluid 302 from the filling port and the valve 303 at the top to become a high-pressure container having the liquid working fluid 302*a* and the gas working fluid 302*b*. The bottom is contacted with the heat source, which is solar heat, high-power electric device, waste heat of internal combustion engine, industrial waste heat, geothermal heat, ocean temperature difference or nuclear reactor. At first, the liquid working fluid 302*a* in the evaporator 301 absorbs heat of the heat source and evaporates into the gas working fluid 302*b*. Owing to a pressure formed by thermal expansion of the gas working fluid 302*b* and the density difference between the liquid working fluid 302*a* and the gas working fluid 302*b*, the gas working fluid 302*b* flows into the condenser 306 through the high-pressure vapor pipe 304. The gas working fluid 302*b* in the high-pressure vapor pipe 304 is outputted from the nozzle 305 inside the condenser 306. The outputted gas working fluid 302*b* lashes on the blade turbine 307 to make it turn. The turned blade turbine 307 drives the DC generator 301 through the axis 308 for generating power. The axis 308 is fixed in the condenser 306 perpendicularly with the first bearing 309*a* and the second bearing 309*b*. After lashing the blade turbine 307, the gas working fluid 302*b* is expanded and contacted with the inner wall of the condenser 306 to transfer heat to the cooling fin 306 through the thick wall of the condenser. Then, the gas working fluid 302*b* condenses into the liquid working fluid 302*a* by dissipating heat through air convection and is then collected in the liquid collecting tank 312. Besides, the cooling fin 311 can be replaced with a cooling coil 316 surrounding on the inner wall of the condenser 306. The low-pressure gas working fluid 302*b* flowing out from the blade turbine 307 is thus cooled down to form the liquid working fluid 302*a* to be gathered in the liquid collecting tank 312.

When the liquid working fluid 302*a* is collected in the liquid collecting tank 312 to a predestined weight, the check valve 313 is pushed to be opened for flowing the liquid working fluid 302*a* into the evaporator 301 through the return flow pipe 314. Because of function of the check valve 313, the liquid working fluid 302*a* in the return flow pipe 314 can only flow from the condenser 306 to the evaporator 301, and can not flow back. An outlet for the liquid working fluid 302*a* in the return flow pipe 314 is located below the surface of the second space 301*a* at evaporator 301 downside. The whole structure of the present invention is fixed and supported by the supporting frame 315 to be perpendicularly stood on the heat source. Through repeatedly evaporating by boiling and condensing by cooling, a closed-loop circulation is formed.

Thus, the present invention is used for dissipating heat or recycling waste heat. Through absorbing heat by a liquid working fluid in an evaporator to form an over-heated vapor gas working fluid, the gas working fluid ascends into a condenser owing to density difference between liquid and gas. The gas working fluid pushes a blade turbine to drive a power generator. Then, the gas working fluid condenses into the liquid working fluid again to be collected in a liquid collecting tank. At last, the liquid working fluid returns the evaporator. A closed-loop circulation is formed. Without using pressure pump for pressuring working fluid back to evaporator, the present invention dissipates heat and generates power, simultaneously. Thus, the present invention has a minimized size with reduced cost and saved energy.

To sum up, the present invention is a fast heat transfer device for simultaneously dissipating heat and generating power, where the present invention is used for dissipating heat or recycling waste heat; the present invention dissipates heat and generates power at the same time; and the present invention has a minimized size with reduced cost and saved energy.

The preferred embodiment herein disclosed is not intended to unnecessarily limit the scope of the invention. Therefore, simple modifications or variations belonging to the equivalent of the scope of the claims and the instructions disclosed herein for a patent are all within the scope of the present invention.

What is claimed is:

1. A fast heat transfer device for simultaneously dissipating heat and generating power, comprising an evaporator, a high-pressure vapor pipe, a condenser, a direct-current (DC) generator, a cooling fin, a liquid collecting tank, a return flow pipe and a supporting frame, wherein said evaporator is a high-pressure container having working fluid; a first space of said evaporator at the upside is filled with a gas working fluid; a second space of said evaporator at the downside is filled with a liquid working fluid; a filling port and a valve are mounted at the first end of said evaporator at top; said working fluid are filled through said a filling port and a valve; a second end of said evaporator at bottom is connected with a heat source to transfer heat of said heat source through wall of said evaporator; said liquid working fluid evaporates to said gas working fluid by absorbing heat of said heat source through said wall of said evaporator; and said gas working fluid leaves from the outlet of said evaporator through said high-pressure vapor pipe;

wherein an outlet of said high-pressure vapor pipe at top is connected with a nozzle inside said condenser at downside; an inlet of said high-pressure vapor pipe at bottom is connected with said first space of said evaporator at the upside; and said high-pressure gas working fluid in said evaporator is guided to said condenser by said high-pressure vapor pipe;

wherein a first bearing and a second bearing are obtained at upside and downside inside said condenser, respectively; a blade turbine and a axis are fixed between said first bearing and said second bearing; said condenser obtains said high-pressure gas working fluid from said high-pressure vapor pipe through said nozzle to make said blade turbine turn; and heat is transferred to said cooling fin and rejected to environment by air convection to obtain said liquid working fluid after cooling said gas working fluid;

wherein said DC generator is mounted outside of said condenser at upside; and said DC generator generates power by turning said blade turbine with kinetic energy transferred from said axis;

wherein said cooling fin is a cooling device outside of said condenser; and said low-pressure gas working fluid flows out from said blade turbine to contact with inner wall of said condenser to transfer heat by said cooling fin to obtain said liquid working fluid; said cooling fin rejects heat to environment by air convection;

wherein said liquid collecting tank is mounted outside of said condenser at bottom to collect said liquid working fluid obtained by cooling said gas working fluid; a check valve is obtained at downside of said liquid collecting tank; and said check valve prevents said liquid working fluid collected in said liquid collecting tank from flowing back to said evaporator through said return flow pipe;

wherein said return flow pipe has an inlet at top to be connected with said liquid collecting tank; said return flow pipe has an outlet at downside to be connected with said second space of said evaporator; and said return flow pipe guides said liquid working fluid in said liquid collecting tank to flow back to said evaporator; and wherein said supporting frame fixes and supports said heat transfer device to be located on said heat source.

2. The device according to claim 1, wherein said working fluid is selected from a group consisting of water, carbon dioxide, ammonia, a refrigerant, a benzene and an alkane.

3. The device according to claim 1, wherein said a filling port and a valve is closed normally and is only opened on filling said working fluid, vacuum pumping and measuring temperature and pressure.

4. The device according to claim 1, wherein said axis is connected with said blade turbine and said DC generator to transfer kinetic energy of said blade turbine to said DC generator and is perpendicularly fixed to said condenser through said first bearing and said second bearing.

5. The device according to claim 1, wherein said first bearing and said second bearing are used to be low-friction contact surfaces between said axis and said condenser, respectively, to fix said axis.

6. The device according to claim 1, wherein said nozzle is located at an output of said high-pressure vapor pipe and is corresponding to an input at said blade turbine.

7. The device according to claim 1, wherein said check valve is mounted between the downside of said liquid collecting tank and upside of said return flow pipe; and said check valve prevents said liquid working fluid collected in said second space of said evaporator from flowing back to said liquid collecting tank and said condenser.

8. The device according to claim 1, wherein said check valve has a spring device inside; and, when the weight of said liquid working fluid in said liquid collecting tank overwhelms the elastic force of said spring device, said check valve is opened to allow said liquid working fluid to flow back to said evaporator through said return flow pipe.

9. The device according to claim 1, wherein said evaporator is a high-pressure container capable of bearing heat expansions of said liquid working fluid and said gas working fluid.

10. The device according to claim 1, wherein said heat source is selected from a group consisting of solar heat, high-power electric device, waste heat of internal combustion engine, industrial waste heat, geothermal heat, ocean temperature difference and nuclear reactor.

11. The device according to claim 1, wherein said cooling fin is replaced with a cooling coil surrounding on an inner wall of said condenser; cooling water flows in the said cooling coil; when said cooling coil is contacted with said low-pressure gas working fluid flows out from said blade turbine, said cooling water absorbs the heat of said low-pressure gas working fluid to condense into said liquid working fluid, and said cooling water is heated to hot water and flows out from said cooling coil for energy recycle.

* * * * *